US007999748B2

(12) United States Patent
Ligtenberg et al.

(10) Patent No.: US 7,999,748 B2
(45) Date of Patent: Aug. 16, 2011

(54) ANTENNAS FOR ELECTRONIC DEVICES

(75) Inventors: Chris Ligtenberg, San Carlos, CA (US); Brett William Degner, Menlo Park, CA (US); Douglas Blake Kough, San Jose, CA (US)

(73) Assignee: Apple Inc., Cupertino, CA (US)

( * ) Notice: Subject to any disclaimer, the term of this patent is extended or adjusted under 35 U.S.C. 154(b) by 521 days.

(21) Appl. No.: 12/061,159

(22) Filed: Apr. 2, 2008

(65) Prior Publication Data

US 2009/0251384 A1 Oct. 8, 2009

(51) Int. Cl.
*H01Q 1/24* (2006.01)

(52) U.S. Cl. ..... 343/702; 455/557

(58) Field of Classification Search ..... 343/702; 455/90, 557, 575

See application file for complete search history.

(56) References Cited

U.S. PATENT DOCUMENTS 5,708,458 A * 1/1998 Vrbanac ..... 345/156
5,913,174 A 6/1999 Casarez et al.
5,983,119 A 11/1999 Martin et al.
6,259,409 B1 7/2001 Fulton et al.
7,106,261 B2 * 9/2006 Nagel et al. ..... 343/702
7,355,299 B2 * 4/2008 Ghabra et al. ..... 307/10.3
2004/0233172 A1 * 11/2004 Schneider et al. ..... 345/168
2005/0093762 A1 5/2005 Pick
2007/0041771 A1 * 2/2007 Choo et al. ..... 400/472
2008/0074329 A1 3/2008 Caballero et al.
2008/0166004 A1 * 7/2008 Sanford et al. ..... 381/375

* cited by examiner

*Primary Examiner* — Tho G Phan
(74) *Attorney, Agent, or Firm* — Treyz Law Group; David C. Kellogg; G. Victor Treyz

(57) ABSTRACT

Key antennas are provided for an electronic device such as a laptop computer. The electronic device may have radio-frequency transceivers that transmit and receive signals using the key antennas. An antenna resonating element may be mounted beneath a keycap of each key antenna. The antenna resonating element may be spirally wrapped and integrated into the keycap. The key antenna may function as an antenna and may also function as an input key for an electronic device. A flexible communications path may pass through a hole in a conductive housing of the electronic device and may be used to couple the antenna resonating element to the radio-frequency transceiver. The antenna resonating element may be coupled to the radio-frequency transceiver by a weak spring. The weak spring may form a portion of the antenna resonating element.

23 Claims, 11 Drawing Sheets

ANTENNAS FOR ELECTRONIC DEVICES

BACKGROUND

This invention relates to antennas, and more particularly, to antennas for electronic devices.

It may be desirable to include wireless communications capabilities in an electronic device. Electronic devices may use wireless communications to communicate with wireless base stations. For example, electronic devices may communicate using the Wi-Fi® (IEEE 802.11) bands at 2.4 GHz and 5.0 GHz and the Bluetooth® band at 2.4 GHz. Electronic devices may also use other types of communications links.

Many popular housing materials for electronic devices such as metal have a high conductivity. This poses challenges when designing an antenna for an electronic device with this type of housing. An internal antenna would be shielded by a high-conductivity housing, so internal antenna designs are often not considered practical in electronic devices with conductive cases. On the other hand, external antenna designs that permanently protrude from a device's housing may have an unattractive appearance. Conventional protruding antenna designs may also be susceptible to damage.

It would therefore be desirable to be able to provide improved antennas for electronic devices.

SUMMARY

In accordance with an embodiment of the present invention, antennas for electronic devices are provided.

An electronic device may have a keyboard. One or more of the keys of the keyboard may be key antennas. For example, one of more of the keys of the keyboard may have antennas integrated into their structure to provide the electronic device with wireless communications functionality.

A key antenna may have an antenna resonating element. The antenna resonating element in the key antenna may be formed using any suitable antenna design. For example, the antenna resonating element may be formed from a flex circuit containing a strip of conductor, a piece of stamped metal foil, a length of wire, etc. The antenna resonating element may be mounted to the underside of a keycap of the key antenna. The antenna resonating element may be integrated into the keycap of the key antenna. The keycap may have a representation of the function of the key. For example, the keycap may indicate to a user that the key is a caps lock key.

The electronic device may have a conductive housing. The key antenna may have improved transmission and reception efficiencies when the key antenna is away from the conductive housing of device 10. For example, the key antenna may have improved transmission and reception efficiencies when the key antenna is not being pressed by a user. In this position, the key antenna's performance may be enhanced by the increase in separation (e.g., compared to the position when the key is pressed) between the antenna resonating element in the key antenna and the ground plane of the conductive housing of the electronic device.

The key antenna may also have an indicator light. The indicator light may include a light source that illuminates a translucent portion of the keycap. The electronic device may use the indicator light to indicate a state of the electronic device that is controlled by the key. For example, the indicator light may indicate whether the caps lock function is active. The indicator light may switch on or off when the user presses the key. With another suitable arrangement, the indicator light may switch on while the user is pressing the key and switch off when the user is not pressing the key.

The electronic device may have a radio-frequency transceiver. The radio-frequency transceiver may be coupled to the antenna resonating element in the keycap of the key antenna. The antenna resonating element may be coupled to the transceiver through a weak spring that flexes as the key is pressed by a user. The antenna resonating element may be coupled to the transceiver through a flexible communications path that flexes into the electronic device as the key is pressed by the user.

The electronic device may provide wireless communications capabilities to otherwise non-wireless devices. The electronic device may also provide keyboard input for non-wireless devices. For example, the electronic device may be coupled to a non-wireless device through a wired universal serial bus interface. The electronic device may provide the non-wireless device with wireless communications capabilities when the radio-frequency transceiver in the electronic device is coupled to the non-wireless device over the wired interface.

The electronic device may provide keyboard input for wireless devices and may extend the wireless capabilities of the wireless devices. For example, the electronic device may wirelessly couple to a wireless device to provide the wireless device with keyboard input capabilities. The electronic device may support wireless communications in additional radio-frequency (RF) bands that are not supported by the wireless device. The electronic device may extend the wireless communications capabilities of the wireless device to include the additional RF bands by relaying wireless communications for the additional RF bands through one or more RF bands that both the electronic device and the wireless device support.

Further features of the invention, its nature and various advantages will be more apparent from the accompanying drawings and the following detailed description.

DETAILED DESCRIPTION

This invention relates to antennas, and more particularly, to key antennas for wireless electronic devices.

The wireless electronic devices may be any suitable electronic devices. As an example, the wireless electronic devices may be laptop computers or other computer equipment. The wireless electronic devices may also be portable electronic devices such as wireless keyboards. With one suitable arrangement, the portable electronic devices may be hand-held electronic devices. These are merely illustrative examples.

Figure 1:
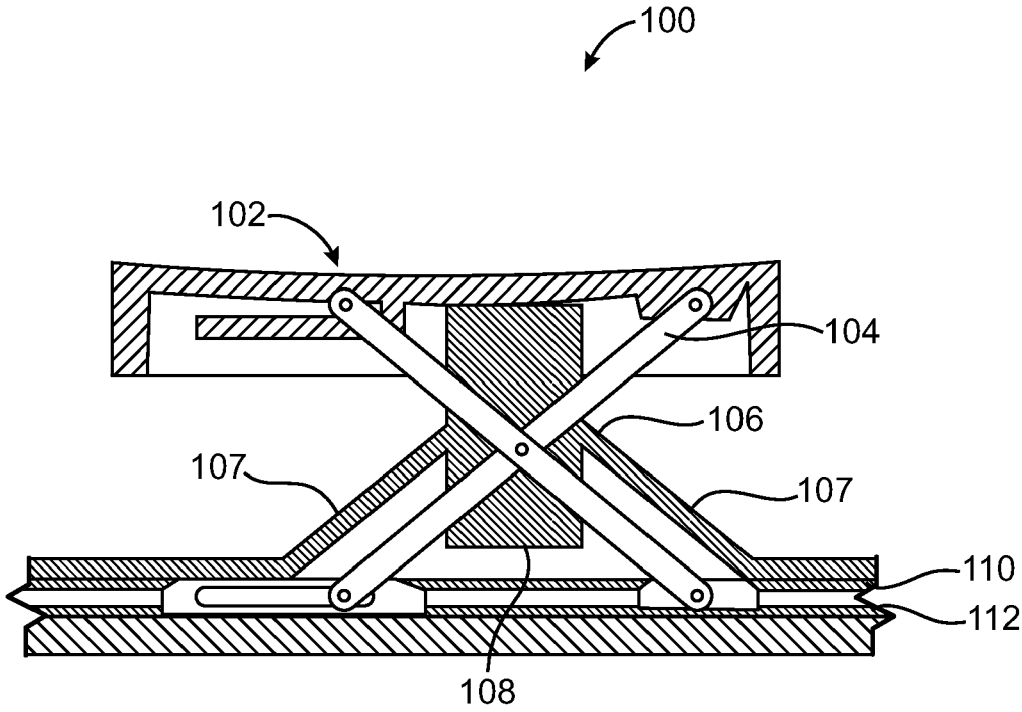
FIG. 1 (PRIOR ART)
FIG. 1 is a cross-sectional view of a conventional key.

A conventional key such as key 100 that may be a part of a keyboard in an electronic device is shown in FIG. 1. Key 100 may include a keycap such as keycap 102 that includes a representation of a key. For example, keycap 102 may have a representation such as "Fn", "A", "Tab" "Alt", "Ctrl", "F", "Esc", "Caps Lock", "Num Lock", a menu symbol, an arrow symbol, or any other key that may be represented in a keyboard for an electronic device. With one suitable arrangement, the representation on a key may include a symbol representing the manufacturer of the software or hardware of the electronic device.

Key 100 may be a part of a keyboard. In the FIG. 1 example, key 100 is supported by a scissor-arm mechanism. Scissor-arm mechanism 100 may keep keycap 102 level and parallel to the base of the keyboard as key 100 is pressed. Scissor-arm mechanism 100 may also prevent keycap 102 from twisting when the key is pressed.

Key 100 may also include a dome-switch to provide tactile feedback to a user. For example, dome-switch 106 may include portions such as portions 107 that collapse when key 100 is pressed. Dome-switch 106 may have portions such as portion 108 that push against membrane 110 when the key is pressed. As portion 108 presses against membrane 110, membrane 110 may contact with and bias against membrane 112. Membranes 110 and 112 may be formed from conductive materials or may be coated with conductive materials such as conductive ink. When key 100 is pressed and membranes 110 and 112 come into contact with each other, an electrical signal associated with key 100 that indicates the key has been pressed may be generated and picked up by electronics in the electronic device.

Figure 2:
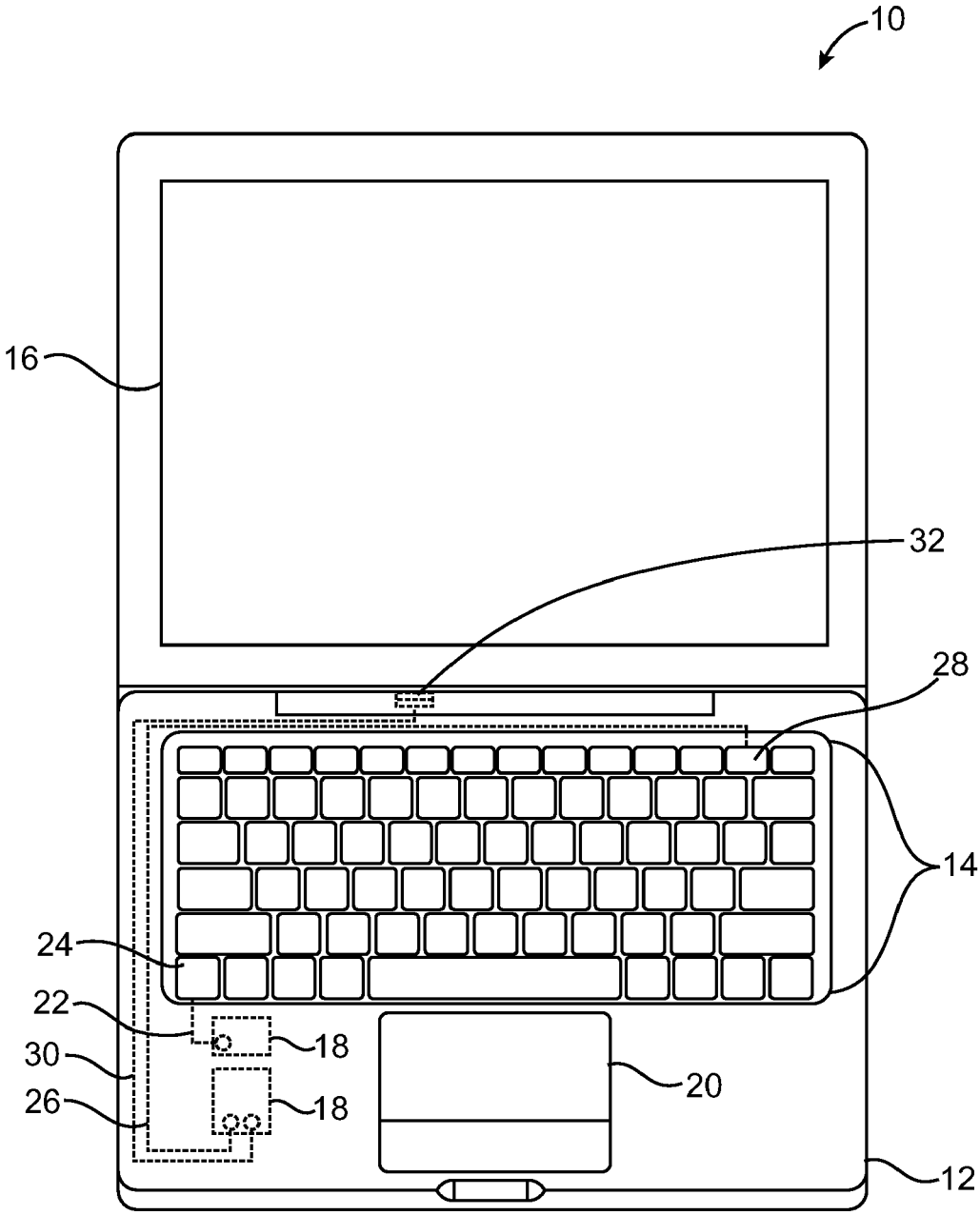
FIG. 2 is an overhead view of an illustrative electronic device with illustrative key antennas in accordance with an embodiment of the present invention.

An illustrative electronic device that may have key antennas is shown in FIG. 2. Device 10 may be any suitable electronic device. For example, device 10 may be a laptop computer or a wireless keyboard.

Device 10 may handle communications over one or more communications bands. For example, wireless communications circuitry in device 10 may be used to handle data communications bands such as the 2.4 GHz band that is sometimes used for Wi-Fi® (IEEE 802.11) and Bluetooth® communications, the 5.0 GHz band that is sometimes used for Wi-Fi communications, the 1575 MHz Global Positioning System band, and 3G data bands (e.g., the UMTS band at 1920-2170). These bands may be covered by using single band and multiband antennas. For example, cellular telephone communications can be handled using a multiband cellular telephone antenna and local area network data communications can be handled using a multiband wireless local area network antenna. As another example, device 10 may have a single multiband antenna for handling communications in two or more data bands (e.g., at 2.4 GHz and at 5.0 GHz).

Device 10 may have housing 12. Housing 12, which is sometimes referred to as a case, may be formed of any suitable materials including plastic, glass, ceramics, metal, other suitable materials, or a combinations of these materials.

Housing 12 or portions of housing 12 may also be formed from conductive materials such as metal. An illustrative metal housing material that may be used is anodized aluminum. Aluminum is relatively light in weight and, when anodized, has an attractive insulating and scratch-resistance surface. If desired, other metals can be used for the housing of device 10, such as stainless steel, magnesium, titanium, alloys of these metals and other metals, etc. In scenarios in which housing 12 is formed from metal elements, one or more of the metal elements may be used as part of the antenna in device 10. For example, metal portions of housing 12 and metal components in housing 12 may be shorted together to form a ground plane in device 10 or to expand a ground plane structure that is formed from a planar circuit structure such as a printed circuit board structure (e.g., a printed circuit board structure used in forming antenna structures for device 10).

Device 10 may have one or more buttons (keys) such as buttons 14. Buttons 14 may be formed on any suitable surface of device 10. In the example of FIG. 2, buttons 14 have been formed on the top surface of device 10. As an example, buttons 14 may form a keyboard on a laptop computer.

If desired, device 10 may have a display such as display 16. Display 16 may be a liquid crystal diode (LCD) display, an organic light emitting diode (OLED) display, a plasma display, or any other suitable display. The outermost surface of display 16 may be formed from one or more plastic or glass layers. If desired, touch screen functionality may be integrated into display 16. Device 10 may also have a separate touch pad device such as touch pad 20. An advantage of integrating a touch screen into display 16 to make display 16 touch-sensitive is that this type of arrangement can save space and reduce visual clutter. Buttons 14 may, if desired, be arranged adjacent to display 16. With this type of arrangement, the buttons may be aligned with on-screen options that are presented on display 16. A user may press a desired button to select a corresponding one of the displayed options.

Device 10 may have circuitry 18. Circuitry 18 may include storage, processing circuitry, and input-output components. Wireless transceiver circuitry in circuitry 18 may be used to transmit and receive radio-frequency (RF) signals. Communications paths such as coaxial communications paths and microstrip communications paths may be used to convey radio-frequency signals between transceiver circuitry and antenna structures in device 10. As shown in FIG. 2, for example, communications path 22 may be used to convey signals between antenna structure 24 and circuitry 18. Communications paths 26 and 30 may be used to convey signals between antenna structures 28 and 32, respectively. Each communications path may be, for example, a coaxial cable that is connected between an RF transceiver (sometimes called a radio) and a multiband antenna (e.g., a multiband key antenna).

Antenna structures such as antenna structures 24 and 28 may be integrated into keys (e.g., buttons 14) of device 10. The antenna structures may be integrated into keys that are not typically pressed by a user. For example, the antenna structures may be integrated into keys such as the "Pause/Break" key, the "Esc" key, or another suitable key. With one suitable example, there may be two antenna structures (e.g., structures 24 and 28) that are integrated into two separate keys that are rarely pressed simultaneously or that are in opposite corners of the keyboard. Device 10 may also have an antenna structure such as antenna structure 32 that is not integrated into a key.

Device 10 may be able to sense when a key antenna (e.g., antenna structure that is built into a key) is pressed by a user and to utilize a different antenna when the key antenna is pressed. For example, when a user presses key antenna 24, device 10 may determine from its keyboard input or from reduced antenna performance that key antenna has been pressed. Device 10 may therefore deactivate key antenna 24 and may active key antenna 28 or antenna structure 32 to maintain wireless communications functionality for the electronic device.

Antenna structures such as antenna structures 24 and 28 (e.g., key antennas) may have antenna resonating elements that are integrated into portions of keys that rise above the housing of the electronic device. For example, antenna resonating elements may be integrated into a keycap or into the support mechanisms (e.g., a scissor-arm mechanism) of a key. Key antennas of this type may be used to increase the efficiency of signal reception and transmission. For example, when device 10 includes a housing such as housing 12 that is formed from conductive materials, antenna structures 24 and 28 may enhance wireless communications functionality by increasing the separation between the ground plane of device 10 and antenna resonating elements in antenna structures 24 and 28 without resorting to conventional external antenna designs that have unsightly protrusions.

Figure 3:
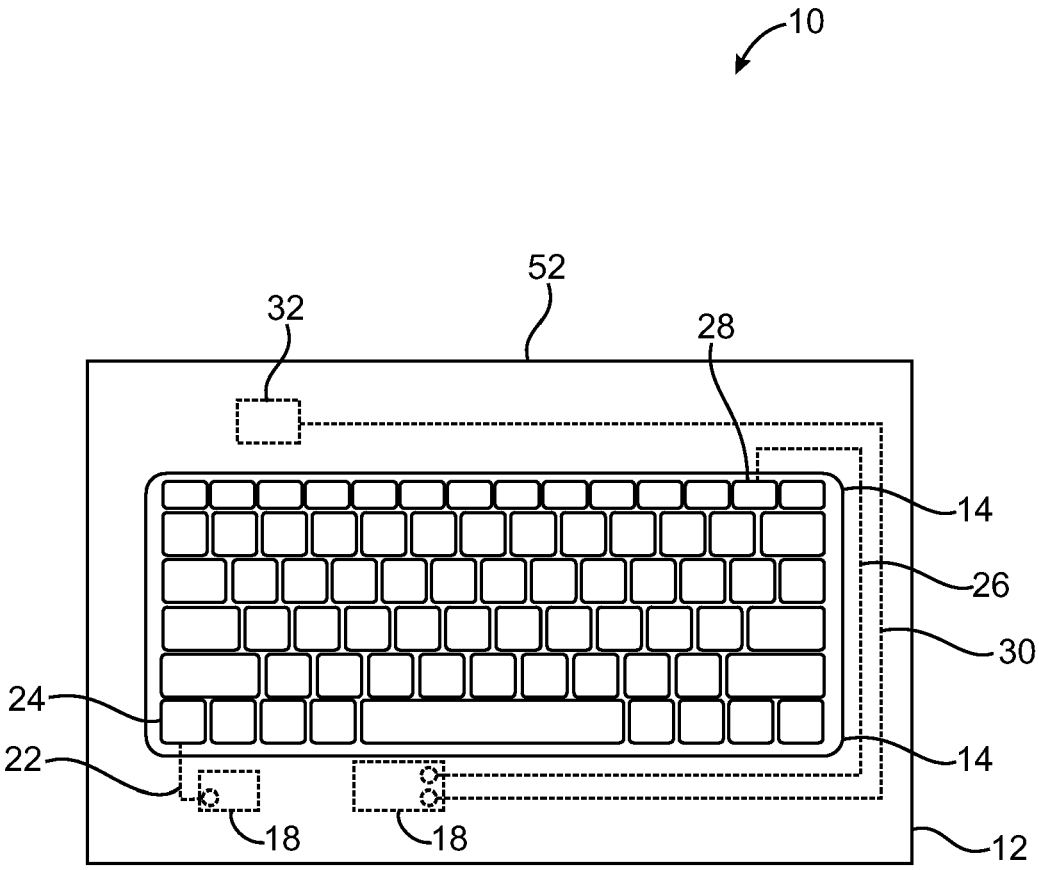
FIG. 3 is an overhead view of an illustrative electronic device with illustrative key antennas in accordance with an embodiment of the present invention.

FIG. 3 shows an illustrative electronic device such as electronic device 10 that may have key antennas. Device 10 may be a wireless keyboard such as keyboard 52 that wirelessly connects to nearby computing equipment or electronic devices (e.g., desktop computers). Keyboard 52 may have all of the features described in connection with device 10 except that a display such as display 16 or a touchpad such as touchpad 20 may be optional in keyboard 52.

With another suitable arrangement, device 10 may be based on a wired keyboard such as keyboard 52 that provides wireless communications functionality to computing equipment (e.g., another electronic device). For example, keyboard 52 may connect to computing equipment (e.g., an electronic device) such as a desktop computer through a conventional universal serial bus interface. The computing equipment may be able to transmit and receive radio-frequency signals using keyboard 52. For example, antennas and radio-frequency transceivers in keyboard 52 may be coupled to the computing equipment by the universal serial bus interface.

Figure 4:
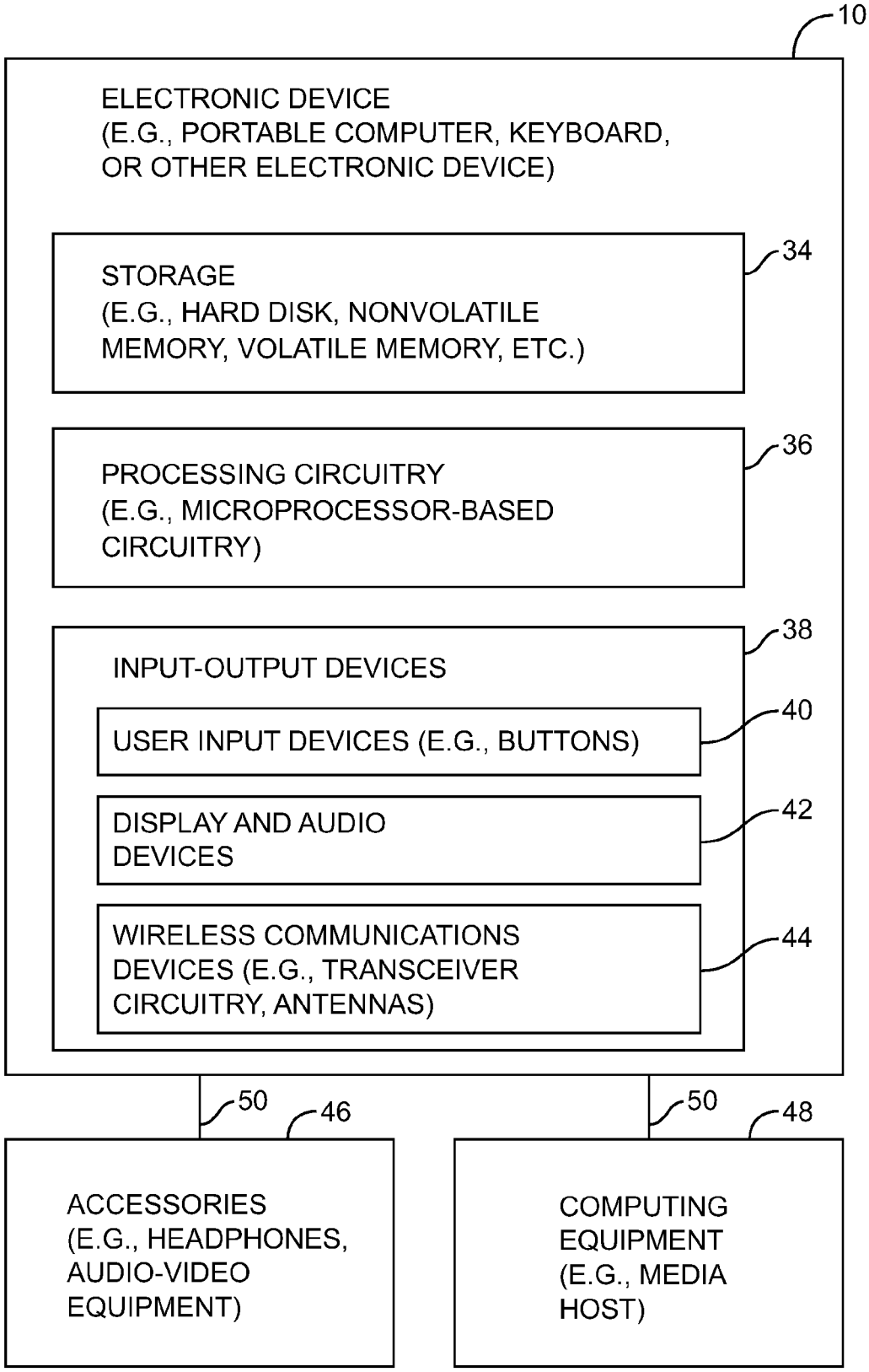
FIG. 4 is a schematic diagram of an illustrative electronic device in accordance with an embodiment of the present invention.

A schematic diagram of an embodiment of electronic device 10 is shown in FIG. 4. Electronic device 10 may be a notebook computer, a wireless keyboard, a wired keyboard, a tablet computer, an ultraportable computer, a handheld computer, a remote control, a game player, a global positioning system (GPS) device, a combination of such devices, or any other suitable portable or handheld electronic device.

As shown in FIG. 4, electronic device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits. With one suitable arrangement, processing circuitry 36 and storage 34 are used to run software on device 10, such as internet browsing applications, voice-over-internet-protocol (VOIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as Wi-Fi®), protocols for other short-range wireless communications links such as the Bluetooth® protocol, protocols for handling 3G data services such as UMTS, cellular telephone communications protocols, etc.

Input-output devices 38 may be used to allow data to be supplied to device 10 and to allow data to be provided from device 10 to external devices. Display screen 16, keys 14 (e.g., keyboard 14), and touchpad 20 of FIG. 2 are examples of input-output devices 38.

Input-output devices 38 may include user input-output devices 40 such as buttons, touch screens, joysticks, click wheels, scrolling wheels, touch pads, key pads, keyboards, microphones, cameras, speakers, tone generators, vibrating elements, etc. A user can control the operation of device 10 by supplying commands though user input devices 40.

Display and audio devices 42 may include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, one or more antennas (e.g., antenna structures such as antenna structures 24, 28, and 32 of FIG. 2), and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless headset or audio headphones) and audio-video equipment (e.g., wireless speakers, a game controller, or other equipment that receives and plays audio and video content).

Computing equipment 48 may be any suitable computer. With one suitable arrangement, computing equipment 48 is a computer that has an associated wireless access point or an internal or external wireless card that establishes a wireless connection with device 10. The computer may be a server (e.g., an internet server), a local area network computer with or without internet access, a user's own personal computer, a peer device (e.g., another electronic device 10), or any other suitable computing equipment.

The antenna structures and wireless communications devices of device 10 may support communications over any suitable wireless communications bands. For example, wireless communications devices 44 may be used to cover communications frequency bands such as the cellular telephone bands at 850 MHz, 900 MHz, 1800 MHz, and 1900 MHz, data service bands such as the 3G data communications band at 2100 MHz (commonly referred to as UMTS or Universal Mobile Telecommunications System), Wi-Fi® (IEEE 802.11) bands at frequencies such as 2.4 GHz and 5.0 GHz (also sometimes referred to as wireless local area network or WLAN bands), the Bluetooth band at 2.4 GHz, and the global positioning system (GPS) band at 1575 MHz. Device 10 can cover these communications bands and/or other suitable communications bands with proper configuration of the antenna structures in wireless communications circuitry 44.

Figure 5:
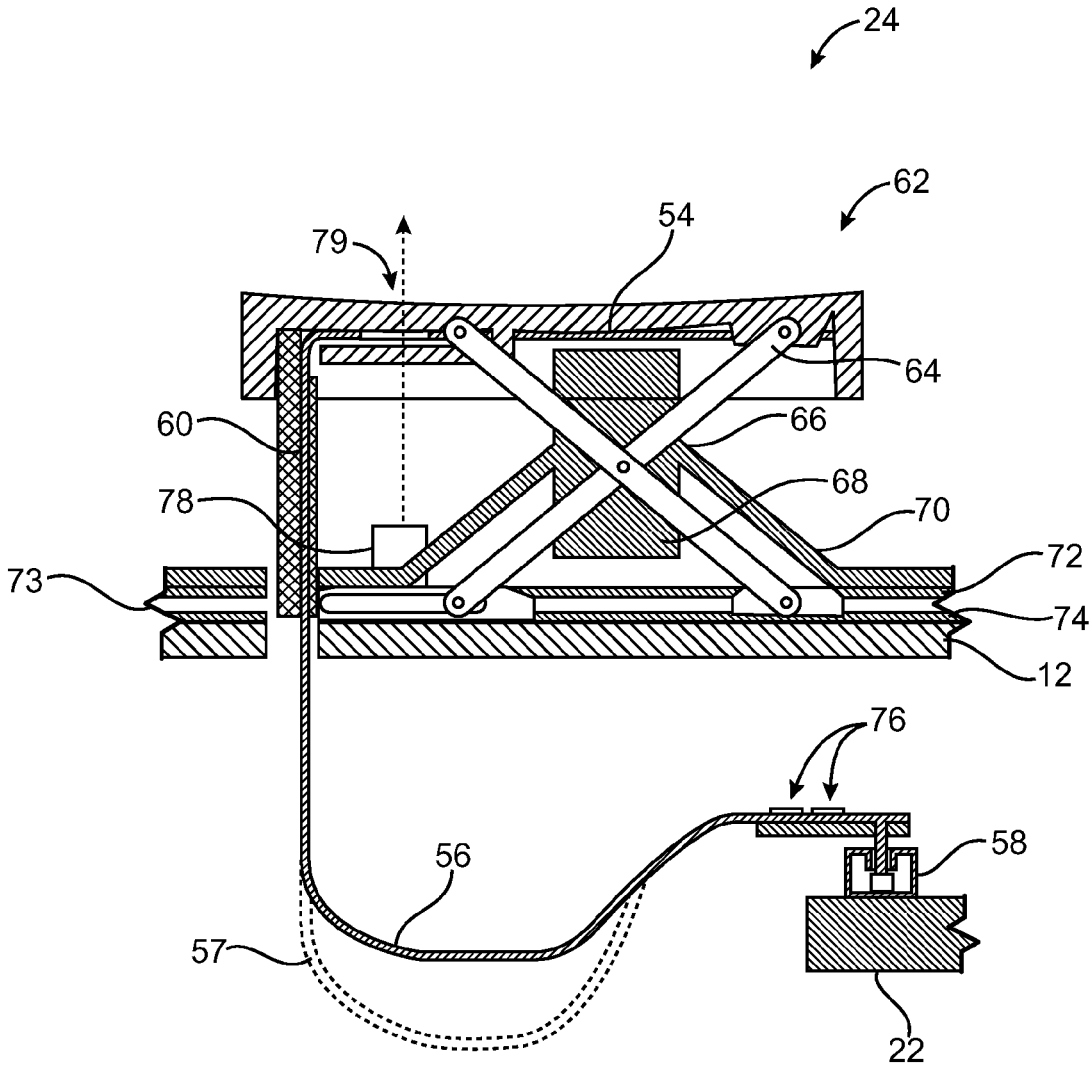
FIG. 5 is a cross-sectional side view of an illustrative key antenna in an illustrative electronic device in accordance with an embodiment of the present invention.

An illustrative key antenna that may be a part of an electronic device such as device 10 is shown in FIG. 5. Antenna structure 24 may be integrated into the structure of a key that is part of a keyboard in device 10 (as an example).

Antenna structure 24 may exhibit improved transmission and reception efficiencies when the antenna structure is located away from the conductive housing of device 10 (e.g., when the key is not being pressed by a user). In this extended position, the antenna's performance may be enhanced by the increase in separation (e.g., compared to the position when the key is pressed) between an antenna resonating element in the antenna and the ground plane of the metal housing of the electronic device.

Antenna structure 24 may have a keycap such as keycap 62 that includes a representation of a key. For example, keycap 62 may have a representation such as "Fn", "A", "Tab" "Alt", "Ctrl", or any other key that may be represented in a keyboard or other keypad of an electronic device. With one suitable arrangement, antenna structure 24 may be integrated into a key that is not commonly pressed by a user of device 10 such as the print screen key.

Antenna structure 24 (key antenna 24) may be a part of a keyboard that utilizes any suitable keyboard technology. For example, the keyboard may be based on keyboard technologies such as dome-switch, scissor-switch, capacitive, mechanical-switch, buckling-spring, Hall-effect, laser and membrane keyboard technologies. In the FIG. 5 example, key antenna 24 is supported by a scissor-arm mechanism. Scissor-arm mechanism 64 may keep keycap 62 level and parallel to the base of the keyboard as key antenna 24 is pressed by a user. Scissor-arm mechanism 64 may also prevent keycap 62 from twisting when the key (e.g., key antenna 24) is pressed.

Key antenna 24 may include a dome-switch to provide tactile feedback to a user. For example, rubber dome-switch 66 may include portions such as portions 70 that collapse when key antenna 24 is pressed. Dome-switch 66 may have portions such as portion 68 that push against membrane 72 when the key is pressed. As portion 68 presses against membrane 72, membrane 72 may contact with and bias against membrane 74. Membrane 73 may be a dielectric membrane that separates membranes 72 and 74. Membrane 73 may have holes located under each portion 68 so that membranes 72 and 74 may contact each other when the key is pressed. Membranes 72 and 74 may be formed from conductive materials or may be coated with conductive materials such as a conductive ink. When key antenna 24 is pressed and membranes 72 and 74 come into contact with each other, an electrical signal associated with key antenna 24 that indicates the key has been pressed may be generated and picked up by electronics in electronic device 10.

Key antenna 24 may have antenna resonating element 54. Antenna resonating element 54 may be formed using any suitable antenna design. For example, the antenna resonating element may be formed from a flex circuit containing a strip of conductor, a piece of stamped metal foil, a length of wire, etc. Radio-frequency signals may pass through keycap 62 to an antenna resonating element (e.g., element 54) that may be affixed to the bottom of keycap 62. With one suitable arrangement, antenna resonating element 54 may be integrated into keycap 62. For example, antenna resonating element 54 may be formed from a spirally wrapped length of wire that is embedded in the material of keycap 62.

Antenna structure 24 may have portions such as portion 60 that carry a communications path or a portion of an antenna resonating element through an opening in device 10. For example, portion 60 may carry communications path 56 from inside device 10 to antenna resonating element 54 outside device 10 through an opening in housing 12. With one suitable arrangement, portion 60 may be formed as part of an antenna resonating element such as antenna resonating element 54.

Circuitry 18 (e.g., a radio-frequency transceiver in device 10) may be electrically coupled to antenna resonating element 54 in key antenna 24 through communications paths 22 and 56 and through coupling structure 58. Circuitry 18 may transmit and receive radio-frequency signals using antenna resonating element 54 as one pole of an antenna. Circuitry 18 may utilize a separate ground plane for the antenna by grounding to a metal structure such as housing 12.

Coupling structure 58 may be used to couple together communications paths 22 and 56. Communications path 22 may be based on a coaxial cable with an inner conductor and an outer conductor. Coupling structure 58 may ground the outer conductor of path 22 to housing 12 of device 10. Coupling structure 58 may couple the inner conductor from path 22 to an inner or positive conductor associated with communications path 56. Tuning elements 76 may be used to tune the electrical coupling between communications paths 22 and 56. Tuning elements 76 may be formed from any suitable elements such as resistors, inductors, capacitors, transistors, etc.

Communications path 56 may flex when key antenna structure 24 is pressed by a user of the electronic device. For example, communications path 56 may be a flex circuit and, as key antenna 24 is pressed, communications path 56 may flex into the position illustrated by line 57 to accommodate the movement of key antenna 24.

Key antenna 24 may have an indicator light with a light source 78 that emits light through a portion of keycap 62 such as portion 79. Light 78 may be an indicator light for a key in device 10. For example, light 78 may indicate whether a caps lock function is active (e.g., by lighting up a portion of the caps lock key). Light 78 may be any suitable light source such as a light emitting diode (LED) or an incandescent light bulb. Portion 79 may be a transparent or translucent portion of keycap 62. Portion 79 may be a hole in keycap 62 that passes light from light 78.

Figure 6:
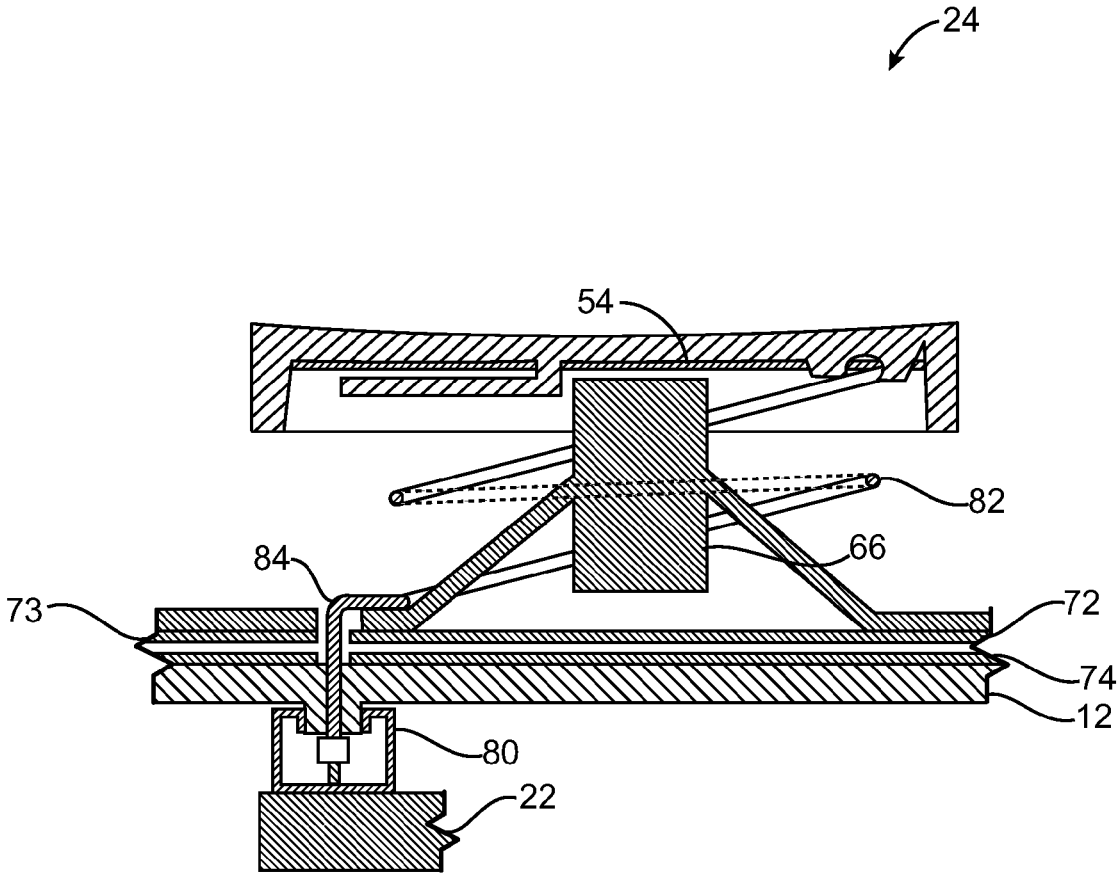
FIG. 6 is a cross-sectional side view of an illustrative key antenna with a weak spring in an illustrative electronic device in accordance with an embodiment of the present invention.

As illustrated by FIG. 6, key antenna 24 may have a spring such as spring 82 that provides feedback to a user when the user presses the key antenna. Spring 82 may be a part of antenna resonating element 54 or may be used as part of a communications path that couples the antenna resonating element to coupling structure 80. For example, antenna resonating element 54 may be partially or entirely formed from spring 82. With one suitable arrangement, spring 82 may be a weak spring that serves to couple antenna resonating element 54 to coupling structure 80 without altering the operation of the key (e.g., so that a user pressing the key may be unable to tell that the key includes spring 82). Scissor-arm mechanism 64 is not shown in FIG. 6 for the sake of reducing visual clutter. However, scissor-arm mechanism 64 may be a part of the key antenna shown in FIG. 6.

Coupling structure 80 may be used to couple communications path 22 to communications path 84, spring 82, and antenna resonating element 54. Coupling structure 80 may couple an inner conductor in communications path 22 to an inner conductor in communications path 84 (e.g., when paths 22 and 84 are coaxial cables). Coupling structure 80 may couple a ground conductor in communications path 82 to housing 12 (e.g., a ground plane in device 10). Coupling structure 80 may be any suitable radio-frequency connector such as a miniature or sub-miniature connector.

Figure 7:
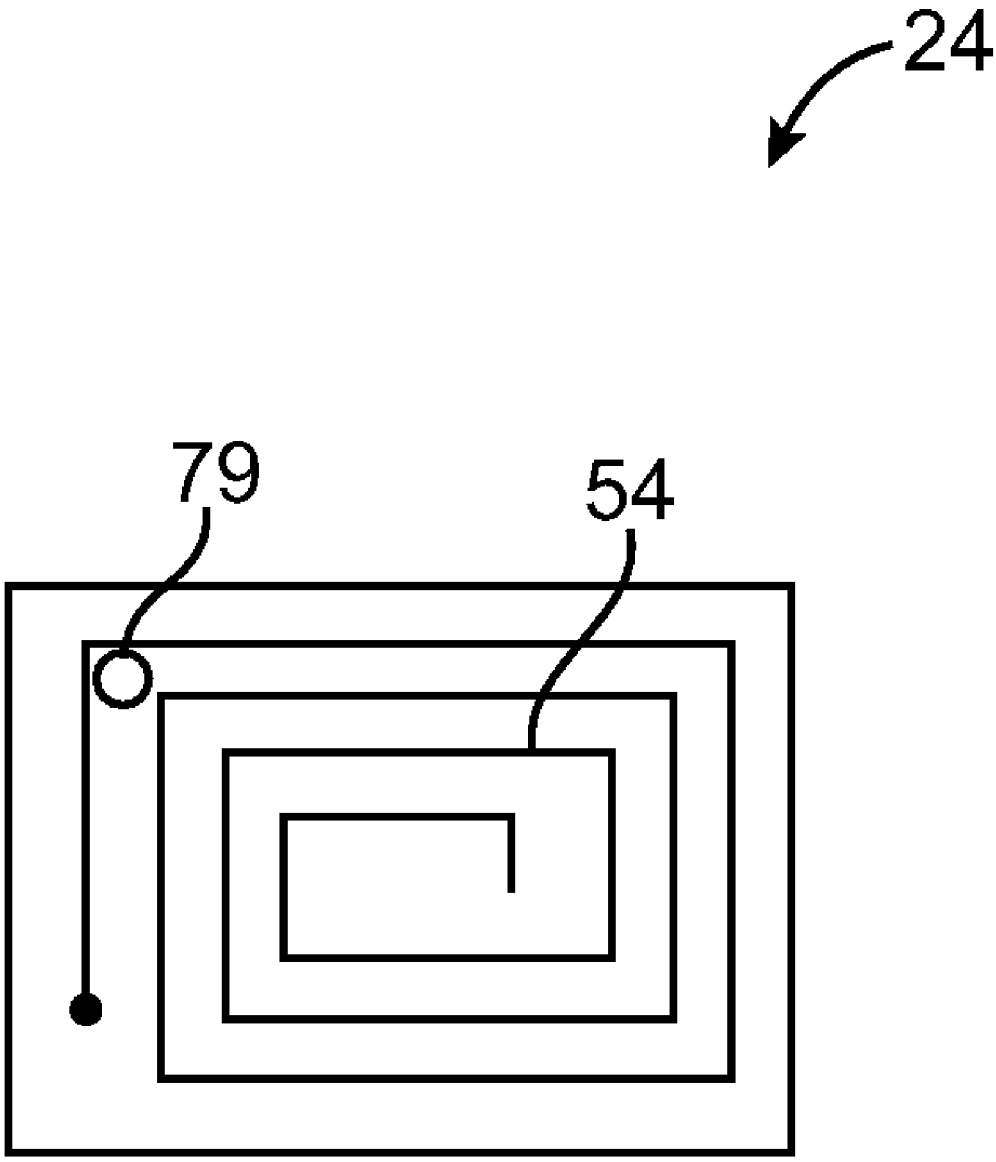
FIG. 7 is a cross-sectional top view of an illustrative keycap that may be part of an illustrative key antenna in an electronic device in accordance with an embodiment of the present invention.

As shown in FIG. 7, key antenna 24 may have a spirally wrapped antenna resonating element. For example, antenna resonating element 54 may be spirally wrapped and affixed to the bottom of a keycap of key antenna 24. With another suitable arrangement, antenna resonating element 54 may be spirally wrapped and integrated into the structure of the keycap of key antenna 24. For example, the antenna resonating element may be formed from a spirally wrapped wire that is embedded in the plastic of keycap 62. Portion 79 may represent a translucent section of the keycap that is lit by light 78 to indicate information about device 10 to a user (e.g., whether caps lock is active).

Figure 8:
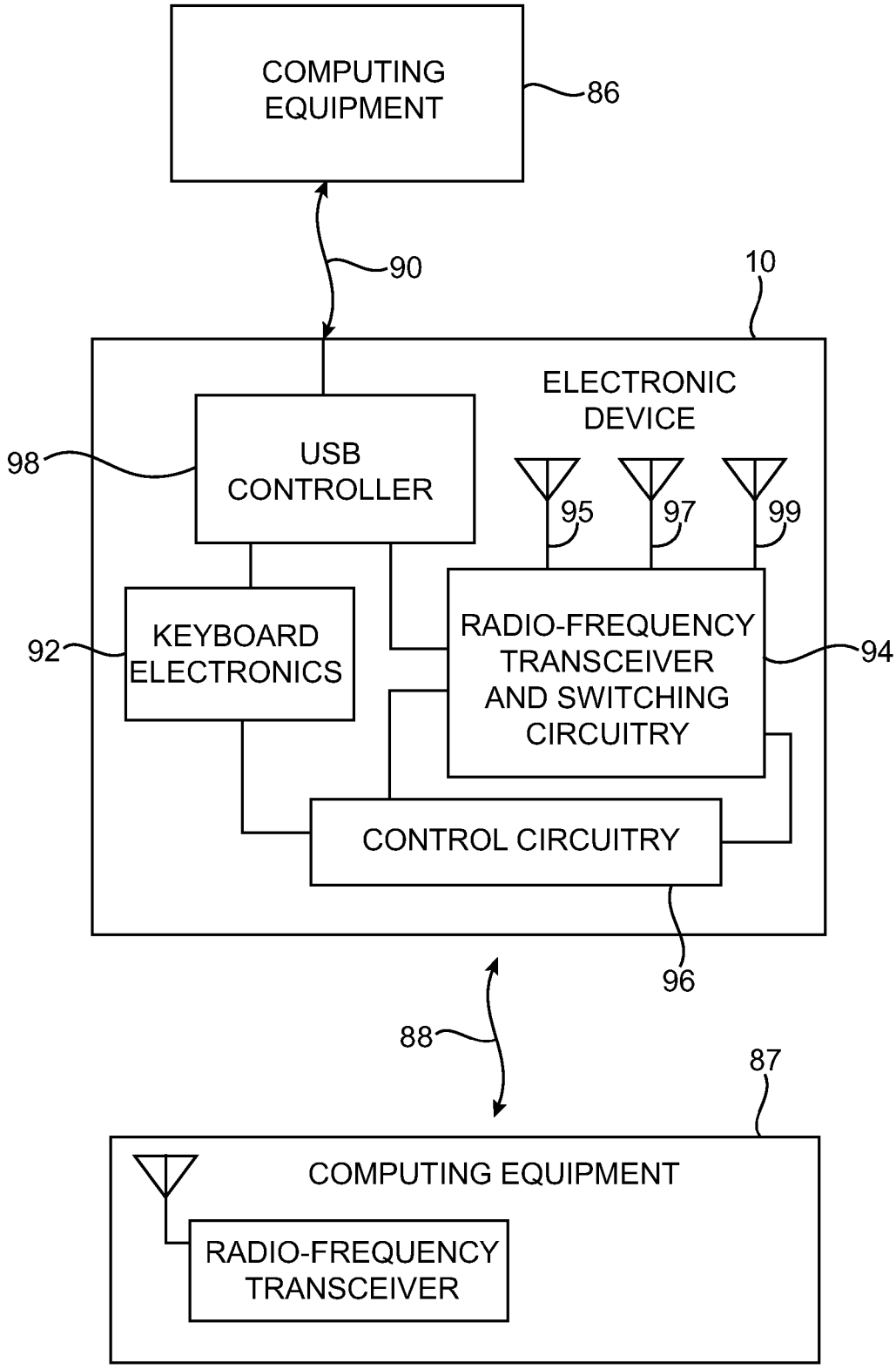
FIG. 8 is a generalized schematic diagram of illustrative computing equipment and an illustrative electronic device that may have key antennas in accordance with an embodiment of the present invention.

An illustrative environment in which electronic device 10 may be used with wired and wireless computing equipment such as computing equipment 86 and 87 is shown in FIG. 8. Computing equipment 86 may be computing equipment (e.g., a second electronic device such as a desktop computer) that does not have wireless communications functionality. Electronic device 10 may be a wired keyboard that provides computing equipment 86 with wireless communications functionality. Electronic device 10 may also act as a conventional keyboard input device for equipment 86. Electronic device 10 may be coupled to computing equipment 86 through a communications path. The communications path may be formed using any suitable communications arrangement. For example, device 10 may be coupled to equipment 86 through a universal serial bus interface such as interface 90 (e.g., a universal serial bus cable). Computing equipment 86 may have one or more universal serial bus ports. With one suitable arrangement, device 10 may have a USB cable that couples to a USB port in computing equipment 86.

Device 10 may provide computing equipment 86 with both keyboard functionality and wireless communications functionality. For example, universal serial bus (USB) controller 98 may couple computing equipment 86 to a radio-frequency transceiver such as transceiver 94 in device 10 over USB interface 90 (e.g., a USB cable). Device 10 may exchange electrical signals over interface 90 with equipment 86. The electrical signals may correspond to radio-frequency signals that are generated and received by radio-frequency transceiver 94. Equipment 86 may use the radio-frequency transceiver of device 10 to perform wireless communications activities (e.g., to send and receive radio-frequency signals).

Device 10 may provide keyboard input for computing equipment 86. For example, keys that are part of a keyboard in device 10 may provide an opportunity for a user to provide input for computing equipment 86. Keyboard electronics 92 may receive user input generated through the keyboard of device 10. Keyboard electronics 92 may relay the signals corresponding to user input on the keyboard to computing equipment 86 through USB controller 98 and USB interface 90.

Computing equipment 86 may wirelessly communicate with computing equipment 87 over a wireless communications link such as link 88 that is provided by electronic device 10. Computing equipment 86 may use radio-frequency transceiver 94 and antennas in device 10 to transmit and receive radio-frequency signals (e.g., to wirelessly communicate with a RF transceiver in equipment 87).

Electronic device 10 may have control circuitry 96. When electronic device 10 has more than one key antenna such as key antennas 95, 97, and 99, control circuitry 96 and transceiver and switching circuitry 94 may select a particular key antenna for use in transmitting and receiving radio-frequency signals. For example, control circuitry 96 may be used in implementing an antenna diversity scheme that selects which of multiple key antennas to use in real-time. With one suitable arrangement, control circuitry 96 may select the key antenna that is receiving the strongest radio-frequency signal for use in transmitting and receiving radio-frequency signals.

In another example, control circuitry 96 may select which key antenna to use based on the historical usage (e.g., numbers of times the key has been pressed) of the key antennas in device 10. For example, when device 10 has two key antennas, control circuitry 96 may maintain a record of the number of times each key antenna is pressed by the user and may select the least pressed key antenna to use in transmitting and receiving radio-frequency signals.

In another example, when device 10 is using a first key antenna for wireless communications, control circuitry 96 may select a second key antenna when the first key antenna is pressed. Control circuitry 96 may receive signals from keyboard electronics 92 when a particular key antenna is pressed indicating that the particular key antenna has been pressed. Transceiver and switching circuitry 94 (e.g., a radio-frequency transceiver) may receive signals from control circuitry 96 that indicate which key antenna is to be used and may switch to the selected key antenna based on those signals.

Figure 9:
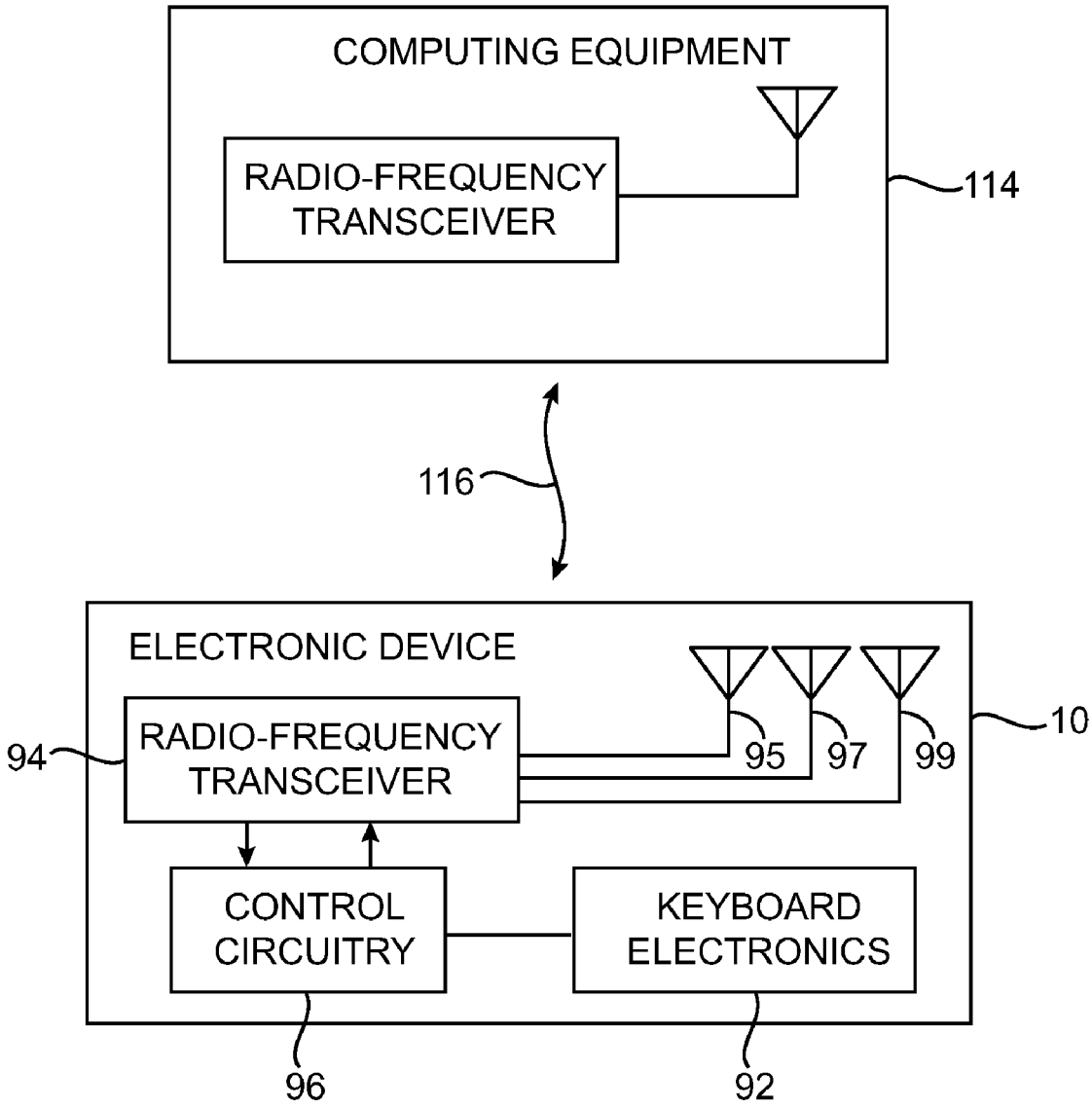
FIG. 9 is a generalized schematic diagram of illustrative computing equipment and an illustrative electronic device that may have key antennas in accordance with an embodiment of the present invention.

A diagram of electronic device 10 in wireless communications with computing equipment 114 is shown in FIG. 9. Device 10 may be a wireless keyboard that provides keyboard input functionality to computing equipment 114. Device 10 may communicate with computing equipment 114 over a wireless communications path such as path 116 (e.g., using transceiver 94 and one or more of key antennas 95, 97, and 99 to communicate with an antenna and a transceiver in computing equipment 114).

With one suitable arrangement, electronic device 10 may extend the wireless communications capabilities of computing equipment 114. For example, electronic device 10 may support a first communications band (e.g., for communications with computing equipment 114) that is also supported by computing equipment 114 and a second communications band that is not supported by computing equipment 114. Device 10 may allow computing equipment 114 to wirelessly communicate with other electronic devices in the second communications band by relaying wireless signals corresponding to the second band between device 10 and equipment 114 over the first communications band (e.g., over link 116).

Figure 10:
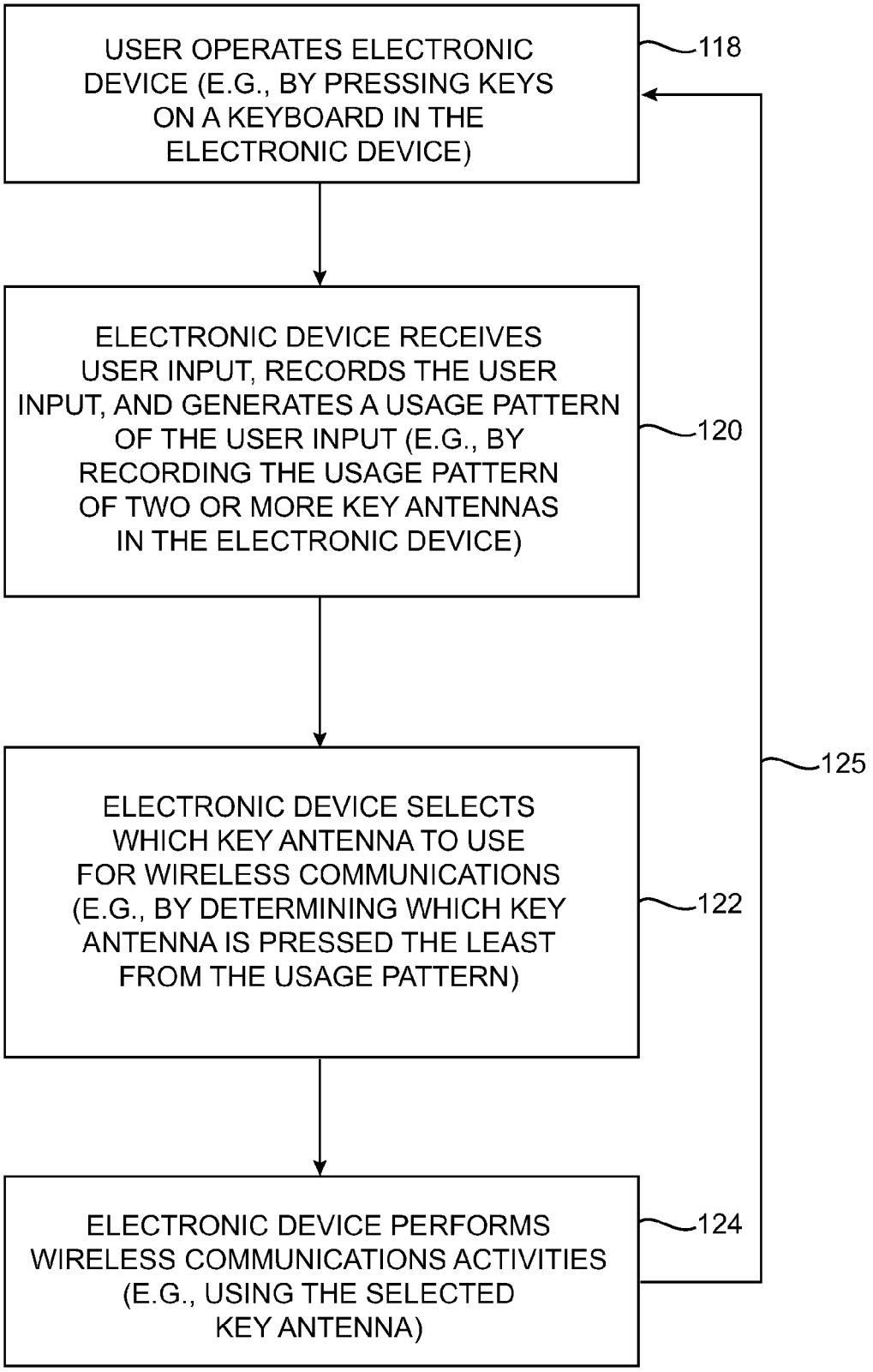
FIG. 10 is a flow chart of illustrative steps involved in using an electronic device that utilizes a usage pattern to select a key antenna to perform wireless communications activities in accordance with an embodiment of the present invention.

Illustrative steps involved in using an electronic device with key antennas such as key antennas 24 and 28 are shown in FIG. 10. The operations of FIG. 10 may be performed when the electronic device (e.g., device 10) is configured to select the least pressed key antenna (e.g., out of two or more key antennas) for use in wireless communications activities.

As shown in FIG. 10, a user may operate the electronic device at step 118. The user may operate the electronic device by, for example, pressing keys on a keyboard in device 10 (e.g., a keyboard formed from buttons 14 or a keyboard such as keyboard 52).

After the user presses one or more keys in device 10 in step 118, electronic device 10 may receive the user input (e.g., key presses) and may record the user input at step 120. Electronic device 10 may generate a usage pattern of the user input from the electronic device's records of the user input. For example, by recording the total number of times particular key antennas are pressed by the user, the electronic device may generate a usage pattern that indicates which key antenna is pressed the least by the user.

At step 122, electronic device 10 may select a key antenna to use for wireless communications activities. With one suitable arrangement, electronic device 10 may select the least pressed key antenna. For example, device 10 may determine which key antenna is the least pressed using the usage pattern of device 10 (e.g., the key antenna keystroke history). The least pressed key antenna may be the key antenna that has been pressed a minimum number of times by the user. For example, the least pressed key may be the key antenna that is least pressed by the user (at least within a given period of time) and therefore may be the least likely to be pressed by the user during subsequent operation of device 10.

At step 124, electronic device 10 may perform wireless communications activities. For example, the electronic device may transmit and receive radio-frequency signals using the key antenna that was selected as being the least frequently pressed in step 122. By selecting the least frequently pressed key antenna, electronic device 10 may enhance the likelihood that the key antenna will be in position for the transmission and reception of radio-frequency signals (e.g., in an extended position such as when the key antenna is not being pressed and blocked by a user's finger).

As indicated by line 125, device 10 may continually updates its records on which keys are least frequently pressed by looping back to step 118 (and therefore step 120).

Figure 11:
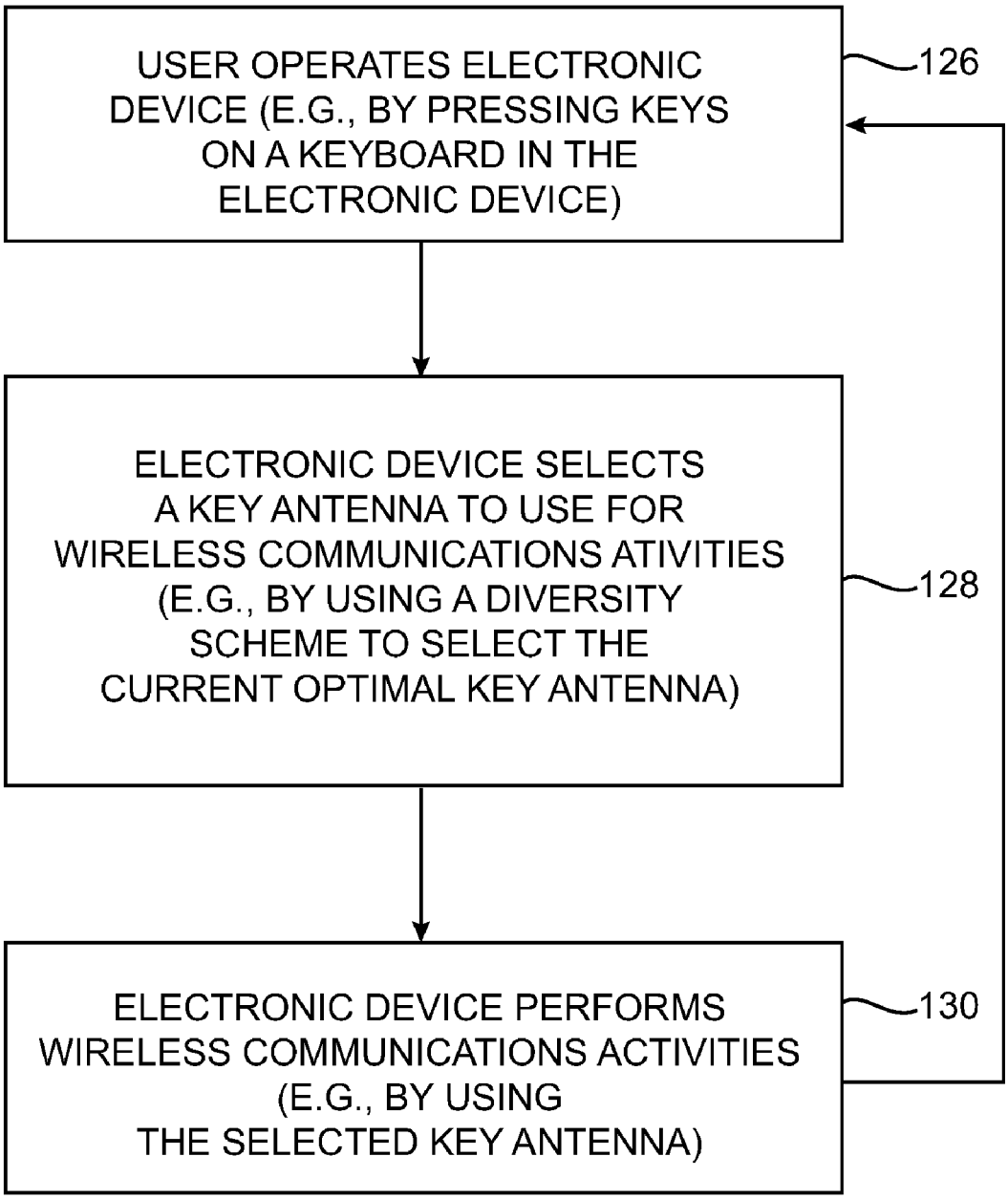
FIG. 11 is a flow chart of illustrative steps involved in using an electronic device that utilizes real-time information to select a key antenna to perform wireless communications activities in accordance with an embodiment of the present invention.

FIG. 11 shows illustrative steps involved in using an electronic device that utilizes real-time information to select which of multiple key antennas to use for wireless communications activities. The operations of FIG. 11 may be performed when the electronic device (e.g., device 10) is configured to use a diversity scheme to select a particular key antenna out of a plurality of key antennas for use in wireless communications activities. For example, electronic device 10 may use a diversity scheme in which the key antenna that has the strongest signal (e.g., the antenna that is receiving the strongest radio-frequency signal from another device) is used to transmit and receive radio-frequency signals.

A user may operate the electronic device at step 126 by, for example, pressing keys on a keyboard in device 10 (e.g., a keyboard formed from buttons 14 or a keyboard such as keyboard 52).

At step 128 the electronic device may select a key antenna for wireless communications activities. The electronic device may select the key antenna for wireless communications using a diversity scheme in which the key antenna that is receiving the strongest signal is selected to perform wireless communications activities. Because the key antenna that is receiving the strongest signal may change as electronic device 10 is operated (e.g., as the user presses keys or physically moves device 10), selection of a key antenna for communications will generally be implemented as an ongoing operation. For example, step 128 may occur continually even when there is no user input being received by device 10.

At step 30, electronic device 10 may perform wireless communications activities. For example, the electronic device may transmit and receive radio-frequency signals using the key antenna that was selected using the diversity scheme in step 128. By selecting the key antenna that is receiving the stronger RF signals, key antenna based transmission and reception of radio-frequency signals may be enhanced (e.g., wireless communications).

The foregoing is merely illustrative of the principles of this invention and various modifications can be made by those skilled in the art without departing from the scope and spirit of the invention.

What is claimed is:

1. An electronic device comprising:

a communications path;

a radio-frequency transceiver that generates and receives radio-frequency signals that are conveyed over the communications path; and a keyboard comprising a plurality of keys, wherein a given one of the keys in the plurality of keys comprises a key antenna and wherein the key antenna comprises an antenna resonating element that is coupled to the radio-frequency transceiver over the communications path.

2. The electronic device defined in claim 1 wherein the given one of the keys further comprises:

a keycap; and a scissor-arm mechanism that keeps the keycap level when the given one of the keys is pressed by a user.

3. The electronic device defined in claim 2 wherein the given one of the keys further comprises a rubber dome switch and wherein the rubber dome switch comprises portions that collapse when the given one of the keys is pressed by the user.

4. The electronic device defined in claim 1 wherein a state of the electronic device is altered when the given one of the keys is pressed by a user and wherein the given one of the keys further comprises an indicator that indicates the state of the electronic device.

5. The electronic device defined in claim 4 wherein the given one of the keys further comprises a keycap, wherein the keycap comprises portions that define a translucent hole in the keycap, and wherein the indicator comprises a light source that illuminates the translucent hole in the keycap.

6. The electronic device defined in claim 1 wherein the communications path comprises a weak spring that flexes when the given one of the keys is pressed by a user.

7. The electronic device defined in claim 1 wherein the communications path comprises a flex circuit that flexes into the electronic device when the given one of the keys is pressed by a user.

8. The electronic device defined in claim 1 further comprising:

a first membrane;

a second membrane, wherein the given one of the keys further comprises portions that bias the first membrane against the second membrane when the given one of the keys is pressed by a user.

9. The electronic device defined in claim 1 wherein the given one of the keys further comprises a keycap, wherein the antenna resonating element comprises a spirally wrapped wire, and wherein the spirally wrapped wire is integrated into the keycap.

10. The electronic device defined in claim 1 wherein the given one of the keys is a first given key in the plurality of keys, the electronic device further comprising:

at least one additional key antenna in a second given key in the plurality of keys; and control circuitry that records the number of times each of the first and second given keys has been pressed by a user, wherein the radio-frequency transceiver is configured to transmit and receive radio-frequency signals using the key antenna in the one of the first and second given keys that has been pressed a minimum number of times by the user in a given period of time.

11. The electronic device defined in claim 1 wherein the given one of the keys is a first given key in the plurality of keys, the electronic device further comprising:

at least one additional key antenna in a second given key in the plurality of keys; and control circuitry that is coupled to the radio-frequency transceiver that determines which key antenna is receiving strongest radio-frequency signals and that directs the radio-frequency transceiver to transmit and receive radio-frequency signals using the key antenna that is receiving the strongest radio-frequency signals.

12. The electronic device defined in claim 1 wherein the electronic device comprises a laptop computer having a processor coupled to the radio-frequency transceiver.

13. The electronic device defined in claim 1 wherein the keyboard comprises a wireless keyboard.

14. The electronic device defined in claim 1 the keyboard comprises a wired keyboard with a universal serial bus cable, the electronic device further comprising:

a desktop computer with a universal serial bus port, wherein the universal serial bus cable and the universal serial bus port convey electrical signals between the wired keyboard and the desktop computer.

15. The electronic device defined in claim 14 wherein the radio-frequency transceiver in the wired keyboard is configured to generate and receive radio-frequency signals for the given one of the keys that correspond to the electrical signals that are conveyed over the universal serial bus cable.

16. A portable computer comprising:

a communications path;

a radio-frequency transceiver that generates and receives radio-frequency signals that are conveyed over the communications path; and a keyboard comprising a plurality of keys, wherein one of the keys in the plurality of keys comprises a key antenna and wherein the key antenna comprises an antenna resonating element that is coupled to the radio-frequency transceiver over the communications path.

17. The portable computer defined in claim 16 further comprising:

keyboard circuitry that generates a signal when one of the keys in the plurality of keys is pressed by a user.

18. The portable computer defined in claim 16 wherein the key antenna comprises a weak spring that flexes when the key antenna is pressed by a user.

19. The portable computer defined in claim 16 wherein the key antenna comprises a keycap and a spiral antenna resonating element located under the keycap.

20. An electronic device comprising:

keyboard circuitry;

a key antenna, wherein the key antenna is configured to generate a signal when the key antenna is pressed by a user and wherein the keyboard circuitry is configured to receive the signal when the key antenna is pressed by the user;

a radio-frequency transceiver; and a communications path, wherein the communications path is configured to convey radio-frequency signals between the radio-frequency transceiver and the key antenna.

21. The electronic device defined in claim 20 wherein the electronic device comprises a portable computer.

22. The electronic device defined in claim 20 wherein the key antenna comprises an antenna resonating element, wherein the communications path comprises a flexible communications path that flexes when the key antenna is pressed by the user.

23. The electronic device defined in claim 22 wherein the key antenna comprises a multiband key antenna, wherein the radio-frequency transceiver comprises a multiband radio-frequency transceiver, and wherein the multiband key antenna and the multiband radio-frequency transceiver are configured to transmit and receive radio-frequency signals in at least two radio-frequency bands.

* * * * *